United States Patent [19]

Growney

[11] Patent Number: 4,749,083

[45] Date of Patent: Jun. 7, 1988

[54] BULB CARTON AND BLANK THEREFOR

[75] Inventor: Lawrence J. Growney, Pearl River, N.Y.

[73] Assignee: Federal Paper Board Co., Inc., Montvale, N.J.

[21] Appl. No.: 289,928

[22] Filed: Aug. 4, 1981

[51] Int. Cl.[4] ..... B65D 85/42

[52] U.S. Cl. ..... 206/418; 229/157

[58] Field of Search ..... 294/87.2, 87.26; 206/158, 521; 229/39 R, 39 B

[56] References Cited

U.S. PATENT DOCUMENTS

| | | | |
|---|---|---|---|
| 1,281,501 | 10/1918 | Brown | 229/39 B |
| 1,284,817 | 11/1918 | Tinsley | 229/39 B X |
| 2,643,814 | 6/1953 | Bradley | 229/39 B |
| 4,291,827 | 9/1981 | Mulroy | 229/39 R |

FOREIGN PATENT DOCUMENTS

| | | | |
|---|---|---|---|
| 1402998 | 5/1965 | France | 229/39 B |
| 197455 | 4/1938 | Switzerland | 229/39 B |
| 194174 | 3/1923 | United Kingdom | 229/39 B |
| 932669 | 7/1963 | United Kingdom | 206/521 |

*Primary Examiner*—George E. Lowrance
*Assistant Examiner*—Gary E. Elkins
*Attorney, Agent, or Firm*—Charles A. Brown; Charles E. Brown

[57] ABSTRACT

This relates to an end structure for a carton, and more particularly to a carton for packaging a light bulb having a projecting base. The end structure is formed of two pairs of end panels, the first pair of end panels including two opposite disposed generally rectangular end panels having slot-like openings therein disposed in angular relation with respect to the connection between the respective end panel and a side wall of the carton. The other pair of end panels are also oppositely disposed and having sloping side edges disposed at a complimentary angle relative to the angle of the openings with respect to the fold line connecting it to the respective side wall. Each of the second end panels has a projecting tab which is lockable within the respective one of the openings. The construction is so that when the first end panels are pressed into the interior of the carton at one end, followed by the pressing of the second end panels into the carton, the tabs will automatically align with the openings and when the end panels are released, they will automatically lockingly engage in place. The relationship of the first pair of end panels within the carton and relative to the bulb base is such that even without the desired interlock with the other pair of end panels, the first pair of end panels applies a wedging action on the bulb base and prevents the release of the bulb.

1 Claim, 2 Drawing Sheets

BULB CARTON AND BLANK THEREFOR

This invention relates in general to new and useful improvements in cartons, and more particularly to an end structure for a carton which is particularly adapted to have retained therein a bulb with a base which projects through the end structure.

Most particularly, the end structure includes a pair of opposed end panels each having an opening therein for receiving a projecting bulb base and the bulb base being recessed within the carton so that the opposed end panels, in the closed state of the carton, slope into the carton. Thus when the bulb attempts to move out of the carton, the movement is greatly restricted in that as the bulb base moves outwardly, it wedges against the end panels.

There are also interlocking means for the end panels which includes slot-like openings on one set of end panels and projecting tabs on a second set of end panels with the tabs being automatically receivable in the openings. The construction of the end structure is such that in order for the end structure to be sufficiently locked in place, only one tab of each of the end panels bearing tabs need engage in an opening of an associated end panel.

Another feature of the end structure is that all of the end panels thereof slope inwardly into the interior of the carton and are urged outwardly by the product packaged within the carton, and the interlock between the end panels being one wherein as the end panels are urged towards a planar condition, the interlock becomes firmer.

Further, there is provided a carton blank including four side panels for defining a rectangular carton with each of the side panels having at one end thereof an end panel for defining an end structure, two opposed end panels having slot-like openings therein and two other opposed end panels having projecting from remote edges thereof tabs for reception in the slot-like openings, and the position of the tabs and openings being such that in an erected carton, the tabs will automatically enter the openings and form an interlock between the end panels.

With the above, and other objects in view that will hereinafter appear, the nature of the invention will be more clearly understood by reference to the following detailed description, the appended claims and the several views illustrated in the accompanying drawings.

Figure 1:
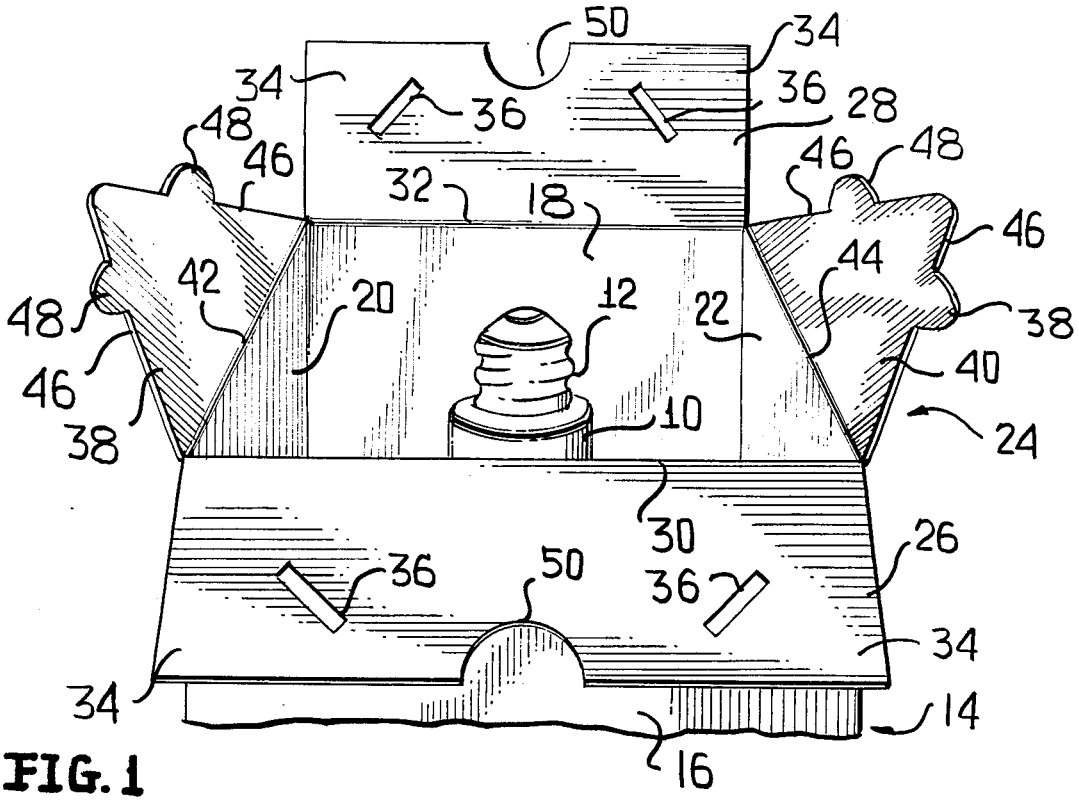
FIG. 1 is a perspective view of one end of a carton incorporating an end structure in accordance with this invention, the end structure being in its open state.
Figure 2:
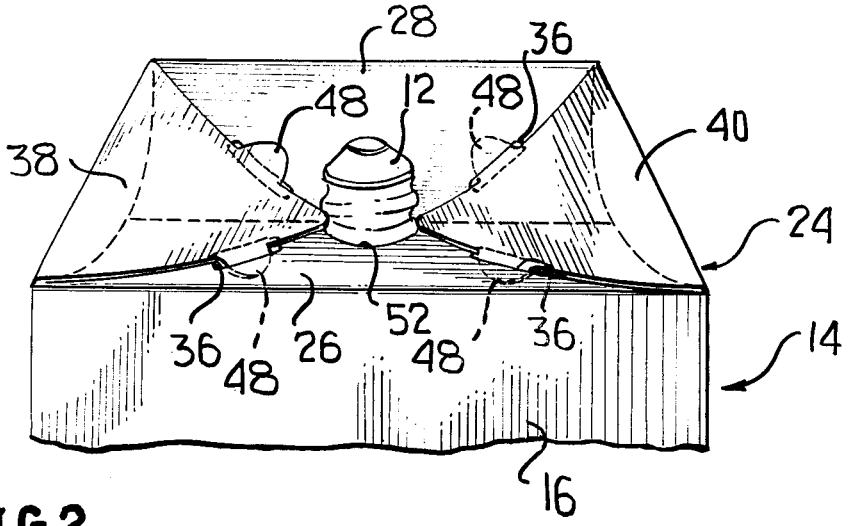
FIG. 2 is a fragmentary perspective view similar to FIG. 1 with the end panels folded inwardly and being interlocked to form the end structure for the carton.

Referring now to the drawings in detail, it will be seen that there is illustrated in FIGS. 1 and 2 a carton particularly adapted for use in the packaging of an electric bulb, and more particularly to a floodlight 10 having a projecting base 12. The carton is generally identified by the numeral 14 and is generally rectangular in cross section.

It is to be noted that the carton 14 is rectangular in cross section and is in part defined by first opposite side walls 16, 18 and second opposite side walls 20, 22. The construction of the opposite end of the carton 14 forms no part of this invention and therefore no effort has been made to illustrate or describe the same. However, when the carton 14 is for the packaging of a bulb, such as a bulb 10, it will be provided with a suitable support at the opposite end thereof so as to position the bulb 10 within the carton 14.

This invention particularly relates to the end structure of the carton 14, the end structure being generally identified by the numeral 24. The end structure 24 includes a pair of oppositely disposed first end panels 26, 28 which are hinged connected to the side walls 16, 18 along hinge or fold lines 30, 32, respectively. Each of the end panels 26, 28 is generally rectangular in outline and has free corners 34. Each of the end panels 26, 28 is provided with a pair of slot-like openings 36 which are disposed adjacent to and generally face the free corners 34, as will be obvious in FIG. 1. It will be noted that each of the openings 36 slopes or is diagonally disposed relative to the fold line connecting the respective end panel to its associated side wall.

The end structure 24 also includes second oppositely disposed end panels 38, 40 which are hingedly connected to the side walls 20, 22 along hinge or fold lines 42, 44, respectively. Each of the second end panels 38, 40 is generally triangular or trapezoidal in outline and has remote converging side edges 46 which slope or are diagonally disposed with respect to a respective hinge or fold line 42, 44 connecting the end panel to its respective one of the side walls 20, 22. The angle of slope of the edges 46 relative to the respective fold line is complimentary to the slope of the openings 36.

Each end panel 38, 40 carries along its respective edges 46 projecting tabs 48 which are located for reception within the openings 36 and which are rounded to facilitate the automatic entry of the tabs into the openings.

At this time it is pointed out that the width of the openings 36 is many times the thickness of the paperboard from which the carton 24 is formed. This also facilitates the automatic entry of the tabs 48 into the openings 36.

In order to define an opening through which the bulb base 12 may project, the free edge of each end panel 26, 28 remote from its respective side wall it provided with a generally semi-circular notch 50.

Referring now to FIG. 2 in particular, it will be seen that the end structure 24 is illustrated in its closed state. At this time the notches 50 combine to define an opening 52 through which the bulb base 12 projects. The end panels 26, 28 have been first folded inwardly and then the end panels 38, 40 have been folded inwardly. It will be seen that at least one tab 48 of each end panel 40 has passed through its respective opening 36 so as to interlock the second end panels 38, 40 with the first end panels 26, 28.

At this time it is to be noted that the end panels 26, 28, 38 and 40 are automatically folded in place and are folded beyond a planar state into the interior of the carton 14. In the forming of the end structure 24, the end panels 38, 40 are overfolded so that they force the end panels 26, 28 further into the interior of the carton 14 then intended so that the tabs 48 will have their free edges aligned with the openings 36 and will automatically enter the the openings 36 when the end panels are released and permitted to spring back. As the end panels are urged out of the carton by the bulb or other product contained therein, this more firmly interlocks the tabs 48 within the openings 36 and provides for a rigid structure.

Although it is desirable that the end panels 38, 40 interlock with the end panels 26, 28 by way of the tabs 48, and this does form a very strong end structure, consideration should be given to the end structure without such an interlock and considering only the end panels 26, 28. Inasmuch as the end panels 26, 28 are interlocked with the base of the bulb 12 and since the end panels slope into the interior of the carton, it will be seen that even if the end panels 38, 40 were not interlocked with the end panels 26, 28, the end panels 26, 28 would resist the complete movement of the bulb out of the carton and the accidental dropping of the bulb with the result being breakage thereof.

Figure 3:
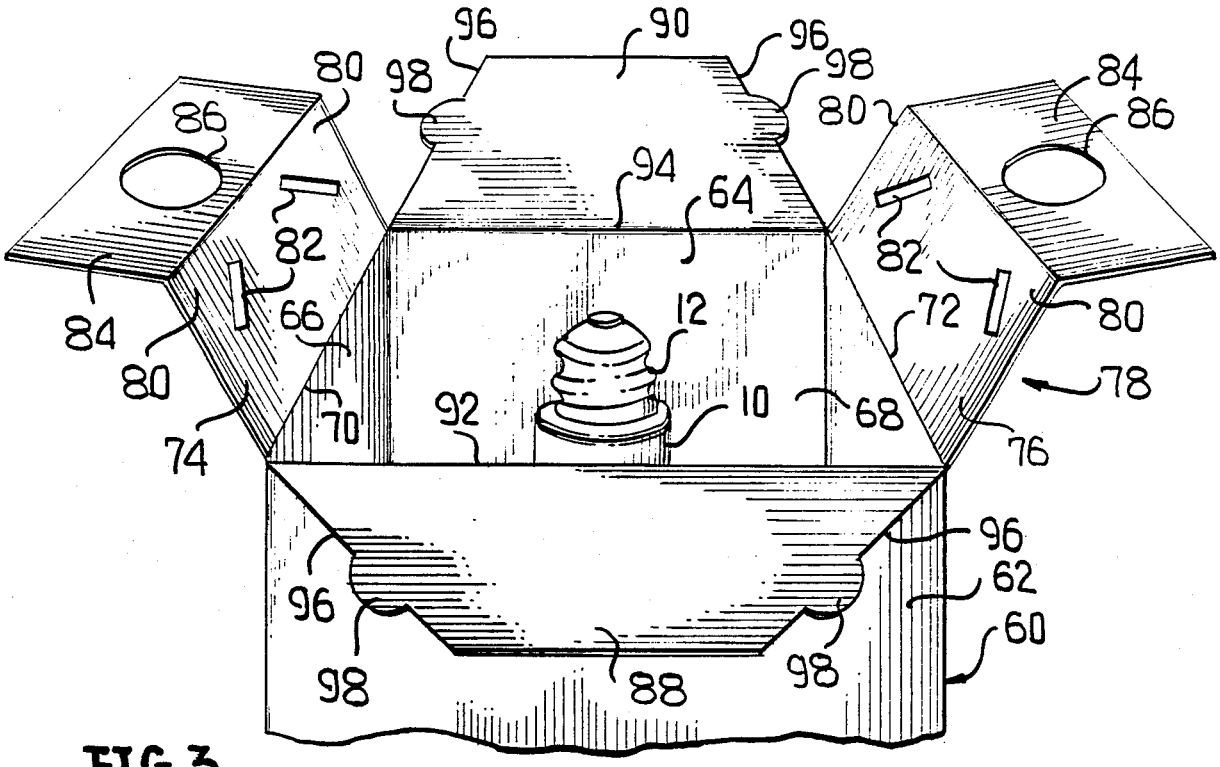
FIG. 3 is a fragmentary perspective view similar to FIG. 1 of a slightly modified form of carton end structure, the end structure being in its open state.
Figure 4:
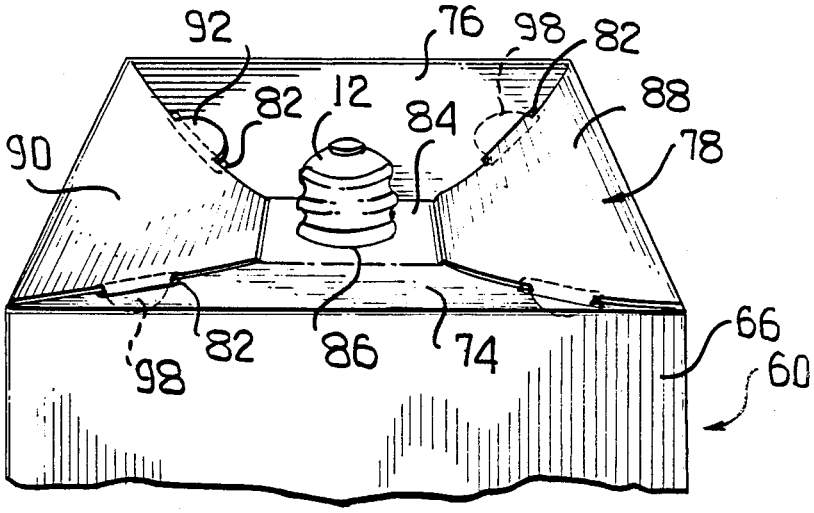
FIG. 4 is a fragmentary perspective view similar to FIG. 2 and shows the modified end structure of FIG. 3 in its closed state.

Reference is now made to FIGS. 3 and 4 wherein there is illustrated another form of carton 60 for packaging the bulb 10. The carton 60 is generally rectangular in cross section and is in part defined by first remote side walls 62, 64 and second remote side walls 66, 68. The side walls 66, 68 carry at their ends along hinge or fold lines 70, 72 end panels 74, 76, respectively, of an end structure generally identified by the numeral 78. The end panels 74, 76 are generally rectangular in outline and have free corners 80 disposed remote from their respective hinge or fold lines 70, 72. Each of the end panels 74, 76 has formed therein adjacent to and generally facing each of the free corners 80 a slot-like opening 82. Each of the openings 82 is in sloping or diagonal relation to a respective fold line 70, 72.

The other or free edge of each of the end panels 74, 76 carries a flap 84. Each flap 84 is provided with an opening 86.

The end structure 78 also includes a pair of oppositely disposed second end panels 88, 90 which are trapezoidal in outline and are connected to respective ones of the side walls 62,68 along hinge or fold lines 92, 94, respectively. Each side panel 94 has sloping or diagonally disposed side edges 96 which slope or are diagonal to a respective fold line 92, 94 at an angle complimentary to the angle of the openings 82 to their respective fold or hinge line 66, 72.

Each of the sloping side edges 96 carries a locking tab 98 which is rounded to facilitate its entry into a respective one of the openings 82.

It is also to be noted that the openings 82, like the openings 36, are of a width many times the thickness of the paperboard from which the carton 60 is formed so as to facilitate the entry of the tabs into the openings 82 so as to interlock the end panels 88, 90 with the end panels 74, 76.

Referring now to FIG. 4, it will be seen that the end structure 78 is in its closed condition with the side panels 74, 76, 88 and 90 sloping into the interior of the carton 60. The flaps 84 are disposed in overlapping relation with the openings 86 thereof aligned to form an opening through which the base 12 projects. At least one of the tabs 98 is illustrated as not having been received in its respective opening 82. However, as described above with respect to the end structure 24, the tabs 98 will automatically enter into the openings 82 when the panels of the end structure 78 are inwardly compressed beyond their intended state so that the tips of the tabs 98 are aligned with the openings and then the end panels released to assume the illustrated position.

In this carton, while interlock of the panels 88, 90 with the panels 74, 76 is also desirable, it will be seen that inasmuch as the panels 74, 76 slope into the interior of the carton and the base 12 of the bulb is received in the openings 86 in the flaps 84, even if the panels 74, 76 were not restrained by the panels 88, 90, when the bulb 10 began to fall out of the bottom of carton, the panels 74, 76 would have to fold towards a planar state at which time the panels 74, 76 will effect a scissoring operation relative to the bulb base 12 and will interlock the flaps 84 therewith so as to prevent complete movement of the panels 74, 76 out of the carton, thus retaining the bulb within the carton.

Although only two preferred embodiments of the end structure of this invention and only a single usage of the end structure has been specifically illustrated and described herein, it is to be understood that minor modifications may be made in the end structures without departing from the spirit and scope of the invention as defined by the appended claims.

What is claimed as new is:

1. An end structure of a rectangular cross sectional carton, said end structure comprising four end panels including a pair of oppositely disposed first end panels and a pair of oppositely disposed second end panels, said first end panels being generally rectangular in outline and having free corners, each first end panel has a pair of slot-like openings therein adjacent to and generally facing said free corners, said openings being diagonally disposed, and second end panels having diagonally disposed remote edges sloping at substantially the same angles as said openings with said diagonally disposed remote edges being substantially aligned with said openings, and a projecting ear extending from each of said diagonally disposed remote edges and aligned with a respective one of said openings, said carton is particularly adapted to hold an electric bulb having a projecting base and said end structure defines an opening between said four end panels for said base, each first end panel carrying a flap remote from its connection with the remainder of the carton, each flap has an opening therethrough, and said flaps being in overlapping relation with said flap openings aligned and defining said opening for said base.

* * * * *